US006003451A

United States Patent [19]

Kelldorf

[11] Patent Number: 6,003,451

[45] Date of Patent: Dec. 21, 1999

[54] TABLE COVER

[76] Inventor: Mitchell T. Kelldorf, 16114 N. 81st St., Scotsdale, Ariz. 85260

[21] Appl. No.: 09/235,928

[22] Filed: Jan. 22, 1999

[51] Int. Cl.[6] ..... A47B 13/08

[52] U.S. Cl. ..... 108/90; 150/158

[58] Field of Search ..... 108/90; 297/219.1, 297/224; 150/158, 154; 5/907, 493, 496; 135/96, 115, 119

[56] References Cited

U.S. PATENT DOCUMENTS

| | | | |
|---|---|---|---|
| 120,530 | 10/1871 | Penrose | 135/96 X |
| 3,295,577 | 1/1967 | Danielson | 108/90 X |
| 5,284,099 | 2/1994 | Cohen | 108/90 |
| 5,887,530 | 3/1999 | Muller | 108/90 |

FOREIGN PATENT DOCUMENTS

| | | | |
|---|---|---|---|
| 792250 | 3/1958 | United Kingdom | 297/224 |

OTHER PUBLICATIONS

Special Events Magazine, vol. 14, No. 1, Jan. 1995, advertisement on p. 69, "Wrapping It Up".

Special Events Magazine, vol. 14, No. 6, Jun. 1995, advertisement on p. 110, "Tableforms. Something Unique".

*Primary Examiner*—Janet M. Wilkens

*Attorney, Agent, or Firm*—Royston, Rayzor, Vickery, Novak Druce, L.L.P.

[57] ABSTRACT

A fabric table cover assembly that includes a table cover body that has a top portion configured for covering a top of a table and a bottom portion configured for covering at least a portion of a supporting legged portion of a table. The bottom portion of the cover body has a lower periphery configured to be anchored at securable locations, one each of those locations to one of a plurality of legs of the table to be covered. The lower periphery has extension portions between adjacent securable locations that are adapted to form upwardly extending arches between adjacent securable locations. In this way feet accommodating access areas are established between adjacent legs of a covered table. The top portion of the table cover body is light colored so that light colored overlay fabrics positioned upon the top portion are colorwise unaffected in appearance by the top portion. The bottom portion of the table cover body is dark colored for forming an opaque skin about a supporting legged portion of a covered table. An overlay table top cover is configured to cover the top portion of the table cover body for presenting a contrasting appearance to the bottom portion of the cover body. The overlay table top cover is adapted to stretch tautly over the top portion of the table cover body for uniform surface-to-surface engagement between the overlay table top cover and the top portion of the table cover body. The overlay table top cover has a peripheral elastic band for constriction below a top of a covered table when installed thereupon.

18 Claims, 4 Drawing Sheets

TABLE COVER

TECHNICAL FIELD

The present invention relates generally to table coverings, and more specifically to table covers for special events where frequent appearance changes are desired.

BACKGROUND ART

Nondescript tables intended to be covered before use are well known in the entertainment, convention and party industries. Typically, the underlying table is of conventional design without decorative features. The top of the table may be of any particular shape, but is usually either square or round. A set of legs is attached to the underside of the table top and are normally foldable into and out of a use configuration. The tables themselves are not attractive and are almost always covered for use. In this way, the cover may be selected so that the tables serve as a complement to the rest of the theme of a event. Usually, conventional table coverings have been simple drapes that are positioned upon the table for uniform appearance. One problem experienced with these designs is that no reference is provided to indicate when the draped table covering has been properly positioned. Therefore, set up of such tables, especially when there is a large number can be time-consuming. Each table must be visually inspected, usually from several different vantage points, to assure that it looks right from all sides. Furthermore, such draped configurations have been in long-time use and the entertainment and party industries desire new and novel appearances, as well as efficient designs for event accessories.

In view of the above described deficiencies associated with the use of known designs of table covers, the present invention has been developed to alleviate these drawbacks and provide further benefits to the user. These enhancements and benefits are described in greater detail hereinbelow with respect to several alternative embodiments of the present invention.

DISCLOSURE OF THE INVENTION

The present invention in its several disclosed embodiments alleviates the drawbacks described above with respect to conventionally designed drape table coverings and incorporates several additionally beneficial features. Among the benefits of the invention is its ease-of-use and durability. Another benefit is the clean, sculpted appearance that it presents when installed upon a table. Still another feature very attractive to the event planning industry is its versatility and ease in appearance-adaptation.

The fabric table cover assembly of the present invention is substantially form-fitting over a conventional party table. Because the fabric from which the cover is constructed is typically stretch material, the table cover assembly is stretched about the table and secured thereupon. The stretch nature of the fabric of construction causes the cover to constrict about the table and partially conform thereto. The result is a curvaceous appearance that is unique, pleasing to the eye and somewhat space-age in affect.

A lower periphery of the bottom of the cover is secured at the feet of the table. Because of the elastic nature of the lower periphery of the cover, upward extending arches are formed between the legs. This is a developed feature highly desirable to those persons who later use the table because these arched areas provide gap spaces between the cover and the floor that accommodate insertion of their feet under the table. The lack of such access for the user's feet in conventional designs has long-affected the level of comfort and usability of such conventional table cover designs.

The table cover of the present invention is constructed in a preferred embodiment to have a top portion and a bottom portion configured to cover the top and legged portions of a table, respectively. The top portion of the table cover is preferably made from a light-colored material and the bottom portion may be constructed in any other desired color. Typically, however, the bottom portion is black because of that color's versatility and ability to blend in many event settings.

The table cover body described immediately above may be utilized alone, but in a preferred embodiment an overlay table top cover is also utilized that is stretched over the top portion of the table cover body. Usually, this overlay table cover will have a particular design such as polka-dots or zebra stripes that can be utilized to customize the appearance of the tables being covered and accent the event in which they are being used. Because the overlay top cover is also constructed of stretch material to enable its easy installation over the top portion of the table cover body and cause conformity thereto, it is easy for the color of the top portion of the table cover body to bleed through light portions of the overlay tabletop cover. For this reason, the top portion of the table cover is preferably constructed from light-colored material, and most preferably, white material. Through the use of such light-colored material, not only is bleed-through prevented, but the colors of the overlay are made more vibrant by the light-colored backdrop of the top portion of the table cover body.

The construction of the table cover body and the overlay cover enable easy, quick and uniform installation of a number of table cover assemblies on different tables. This is important for event planners since setup time is most always eat a premium. The setup time for in event is non-revenue generating and therefore is desired to be minimized. The construction of the table cover assembly of the present invention also enables a lone person to install the cover quickly and accurately by him or herself without damaging the cover. This one-person installation is accommodated by the construction of the table cover and its method of installation and attachment upon a table. Because of the stretching nature of the table cover in its preferred embodiment, the lower periphery of the bottom portion of the cover may be easily hooked under the feet of the table's legs. This can be accomplished one at a time as the installer moves about the table. Simultaneously, the top portion of the cover, as well as the bottom portion of the cover is being stretched tautly about the tabletop and legged portions of the table, respectively. In this manner, as the installer progresses about the table, each leg can be rocked off of the floor to permit placement of a securable portion of the cover thereunder. This type of installation prevents the top of the table from having to engage the floor and averts potential damage to cover if it were pinched between the table top and floor.

In a preferred embodiment, the bottom portion of the table cover is constructed in a tube configuration using a longitudinal seam that can be used by the installer as a reference point for proper positioning of the cover upon the table. By aligning the seam with a leg of the table, not only is a better appearance achieved for each table, but a uniform appearance across several tables is assured when each is similarly covered.

In at least one embodiment, the present invention takes the form of a fabric table cover assembly that includes a table cover body that has a top portion configured for covering a top of a table and a bottom portion configured for covering at least a portion of a supporting legged portion of a table. The bottom portion of the cover body has a lower periphery configured to be anchored at securable locations, one each of those locations to one of a plurality of legs of the table to be covered. The lower periphery has extension portions between adjacent securable locations that are adapted to form upwardly extending arches between adjacent securable locations. In this way feet accommodating access areas are established between adjacent legs of a covered table.

The top portion of the table cover body is light colored so that light colored overlay fabrics positioned upon the top portion are colorwise unaffected in appearance by the top portion of the underlying cover. In a preferred embodiment, the light colored top portion of the table cover body is white for optimized color preservation of overlay fabrics positioned upon the top portion.

The bottom portion of the table cover body is dark colored for forming an opaque skin about a supporting legged portion of a covered table.

In one embodiment, the top portion and the bottom portion of the table cover body are separate fabric pieces joined together at a seam to form the table cover body and the seam is configured to be located immediately below a top of a covered table when installed thereupon.

Additionally, an overlay table top cover is configured to cover the top portion of the table cover body for presenting a contrasting appearance to the bottom portion of the cover body. Preferably, the overlay table top cover is adapted to stretch tautly over the top portion of the table cover body for uniform surface-to-surface engagement between the overlay table top cover and the top portion of the table cover body. Further, the overlay table top cover has a peripheral elastic band for constriction below a top of a covered table when installed thereupon. In a particularly preferred embodiment, the overlay table top cover is constructed from stain and wrinkle resistant material.

In one embodiment, the securable location takes, at least in part, the form of a hookable portion of the bottom portion of the table cover body and is configured for being securingly hooked under a leg of a covered table. In an alternative embodiment, the securable location includes a cupped receiver positioned at the lower periphery of the bottom portion of the table cover body and is configured to securably receive a foot portion of a leg of a covered table. The cupped receiver is adapted to be releasably engageable upon the lower periphery of the bottom portion of the table cover body.

Preferably, the bottom portion of the table cover body is constructed from stretch fabric and is configured to fit tautly about the supporting legged portion of a covered table thereby presenting a curvaceous appearance about the supporting legged portion when installed. In one exemplary embodiment, the stretch fabric from which the bottom portion of the table cover body is constructed is spandex material and the top portion of the table cover body is constructed from stain and wrinkle resistant material. Further, the bottom portion of the table cover body includes a peripheral elastic band for constriction about a lower portion of a supporting legged portion of a covered table thereby forming the upwardly extending arches and presenting a fluted appearance at a base of a covered table from a plurality of the arches.

In one version, the bottom portion of the table cover body is tubularly constructed and is formed from a sheet of material using a seam that is configured to be aligned with a leg of a covered table.

The beneficial effects described above apply generally to the exemplary devices and mechanisms disclosed herein of the fabric table cover. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

Figure 1:
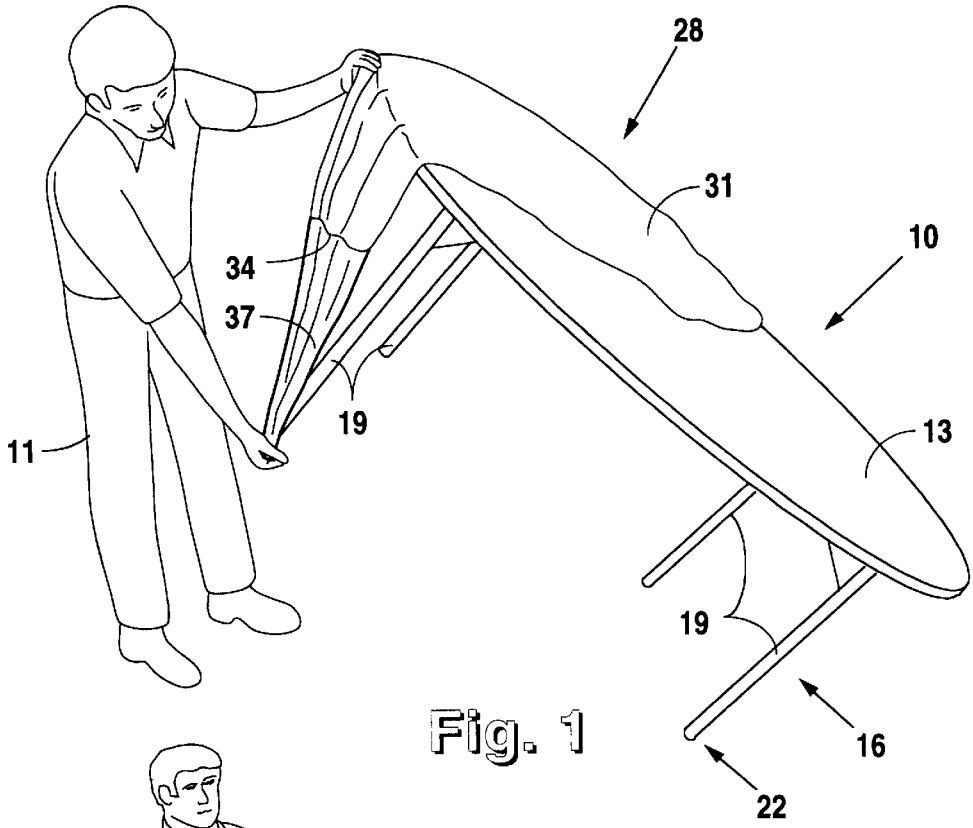
FIG. 1 is a perspective view showing the initial installation step of the present invention onto a table.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Referring to the accompanying drawings, a table cover assembly 25 may be appreciated that is utilizable for covering a table 10 having a table top 13 and a supporting legged portion 16. The supporting legged portion 16 includes a plurality of legs 19 each of which has a foot portion 22.

Figure 3:
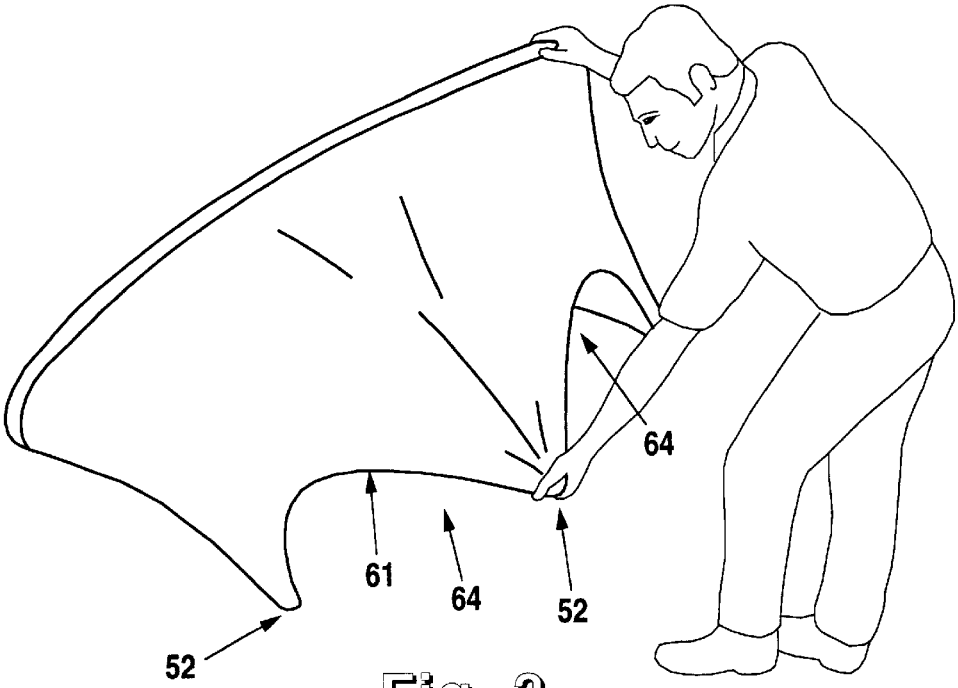
Figure 4:
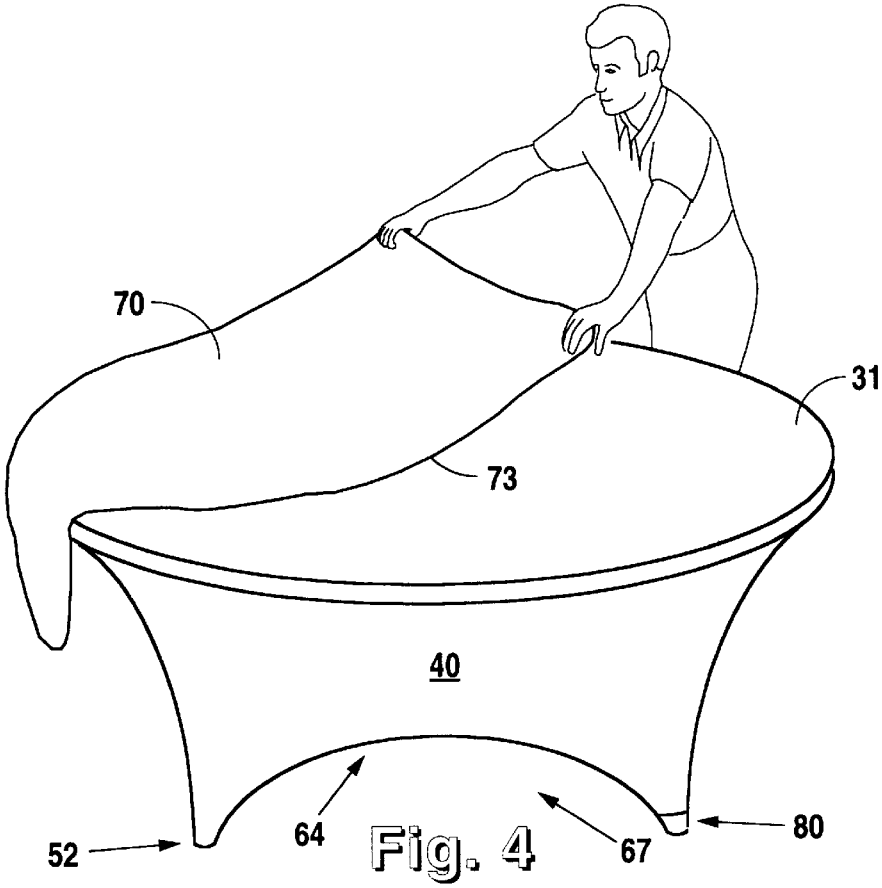
FIG. 4 is an illustration of an initial step of installation of an overlay cover atop the table cover body.

As may be appreciated in FIG. 1, a table cover body 28 is configured for installation over the table 10. The cover body 28 includes a top portion 31 and a bottom portion 37 preferably joined together by a seam 34. Each of the top and bottom portions 31,37 are preferably constructed from stretch material, and most preferably the top portion 31 is constructed from miliken polyester which is stain and wrinkle resistant and the bottom portion 37 is constructed from spandex. Because of the stretching nature of the construction material, the table cover body 28 exhibits an elastic affect through its constructive characteristics about the table 10. As illustrated in FIGS. 3 and 4, these characteristics enable the cover 28 to be at least partially form-fitting about the table 10 in a curvaceous manner which produces the unique appearance of the installed cover assembly 25.

As illustrated in FIG. 1, the installation process begins with an installer 11 positioning the table cover body 28 substantially upon the top 13 of the table 10. At least one leg 19 is lifted off of the ground so that the bottom portion 37 of the cover body 28 can be anchored at a securable location 52 at the foot portion 22 of the leg 19. In a preferred embodiment, the securable locations 52 are at a lower periphery 49 of the bottom portion 37. Optionally, a peripheral elastic band 46 may be included at the periphery 49, but it is also possible for the material from which the bottom portion 37 is constructed to perform satisfactorily utilizing its own elastic qualities. In the embodiment illustrated in FIGS. 1 and 2, the securable location 52 takes the form of a hookable portion 55 which is achieved by pulling the lower periphery 49 underneath the foot portion 22 and permitting it to constrict thereunder.

In an alternative embodiment which is designated at the righthand foot portion 22 of FIG. 4, a cupped receiver 80 is utilized at the lower periphery 49 for installation under the foot 22. Preferably, the cupped receiver 80 is constructed from substantially rigid, durable material such as plastic, and in a preferred embodiment is releasably engageable at the lower periphery 49 of the bottom portion 37 of the cover body 28. It is contemplated that the cupped receiver 80 may be constructed from two body pieces which are substantially conforming, one to the other, so that together they can be effectively snapped about the lower periphery 49 for attachment thereto. The receiver 80 is interiorly configured for receiving the foot portion 22 therein. Because of the receiver's 80 design, it should be appreciated that it may be used on other types of covers, such as those for chairs and other pieces of furniture.

Figure 7:
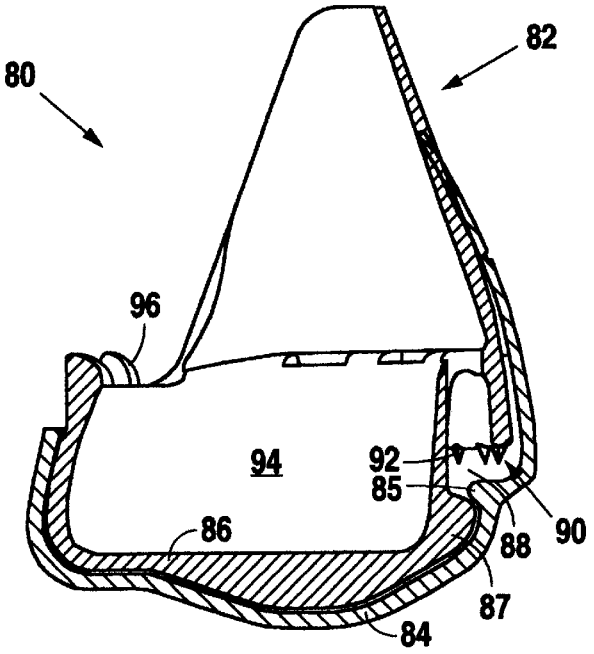
FIG. 7 is a cross-sectional view of a two-piece cup receiver.
Figure 8:
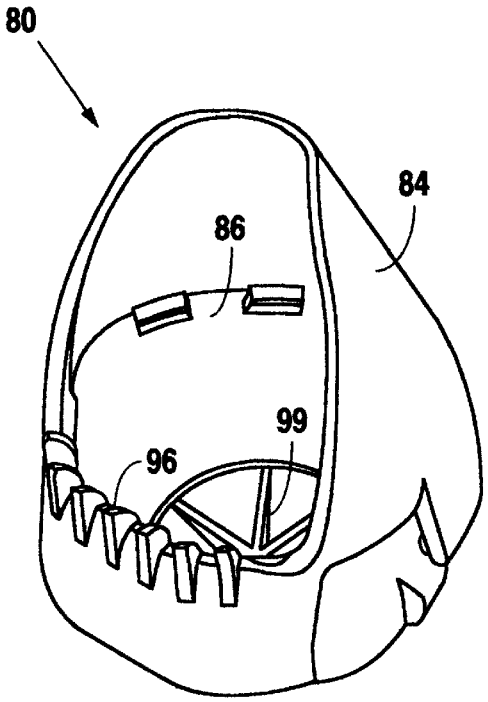
FIG. 8 is a perspective view of a two-piece cup receiver.
Figure 9:
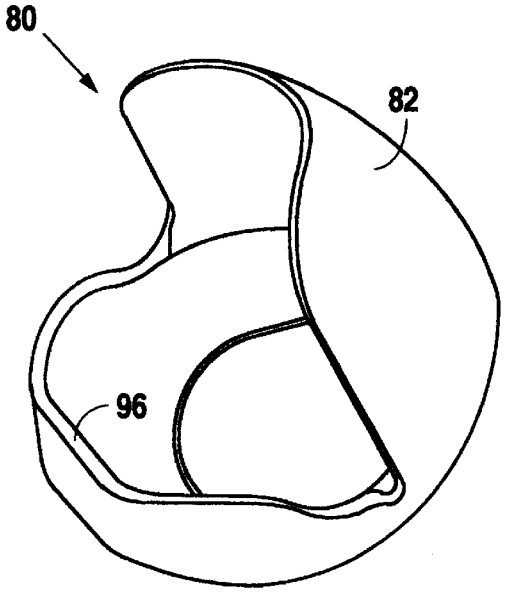
FIG. 9 is a perspective view of a unibody cup receiver.

Exemplary embodiments of the cupped receiver 80 are illustrated in FIGS. 7–9. FIG. 9 illustrates a unified receiver body 82 and FIGS. 7 and 8 illustrate two-piece receiver bodies 82. Regarding FIG. 7, a cross-sectional view of the cupped receiver 80 is provided that shows that the receiver 80 is formed by the snapped engagement of an outer shell 84 about an interior insert 86. The outer shell 84 includes a catch projection 85 that projects over and snaps about a protrusion 87 off of the interior insert 86. In this manner, the two halves 84,86 are made releasably engageable, one to the other. As may also be appreciated in FIG. 7, an interior surface of the outer shell 84 is configured to conform to an exterior surface of the insert 86 for substantial face-to-face abutment. When assembled, a cover securement recess 88 is established between the two halves 84,86 which is utilized for securingly receiving a portion of the lower periphery 49 of the bottom portion 37 of the table cover body 28. Securement of the cupped receiver 80 to the table cover 28, or to any other cover similarly constructed at a lower periphery such as a chair cover, is established by snapping the two halves 84,86 together with the portion of the cover intended to be secured positioned theretween. Friction members 90 are provided in the form of spiked teeth 92 that stab into the secured cover portion. Through the use of the teeth 92, disengagement of the cover 28 from the cupped receiver 80 is resisted until the two halves 84,86 are purposefully disengaged and the recess 88 opened.

An interior foot receiving area 94 is established within an interior space of the cupped receiver 80. It is in this area 94 that the foot portion 22 of a table 10, or alternatively a chair, is received. The fit of the area 94 about the foot portion 22 may be sufficiently snug to maintain an engagement therebetween. Still further, the elastic nature of the table cover 28 places an upward force on the cupped receiver 80 which also tends to hold the receiver 80 tightly upon the foot portion 22. To aid an installer in properly positioning the foot portion 22 in the receiving area 94, a sloped access lip 96 is provided that directs the foot portion 22 to slide into the receiving area 94 for proper positioning therein. Because there is the possibility that a great deal of downward force may be imposed upon the cupped receiver 80, especially if the receiver is utilized on a chair cover, a bottom portion 94 of the receiver 80 is reinforced utilizing reinforcing ribs 99. In the embodiment illustrated in FIG. 8, the ribs 99 extend radially from a center of the interior insert 86 toward a circumference thereof. The ribs 99 take the form of vanes that are perpendicularly oriented to the bottom interior surface of the insert 86.

Figure 2:
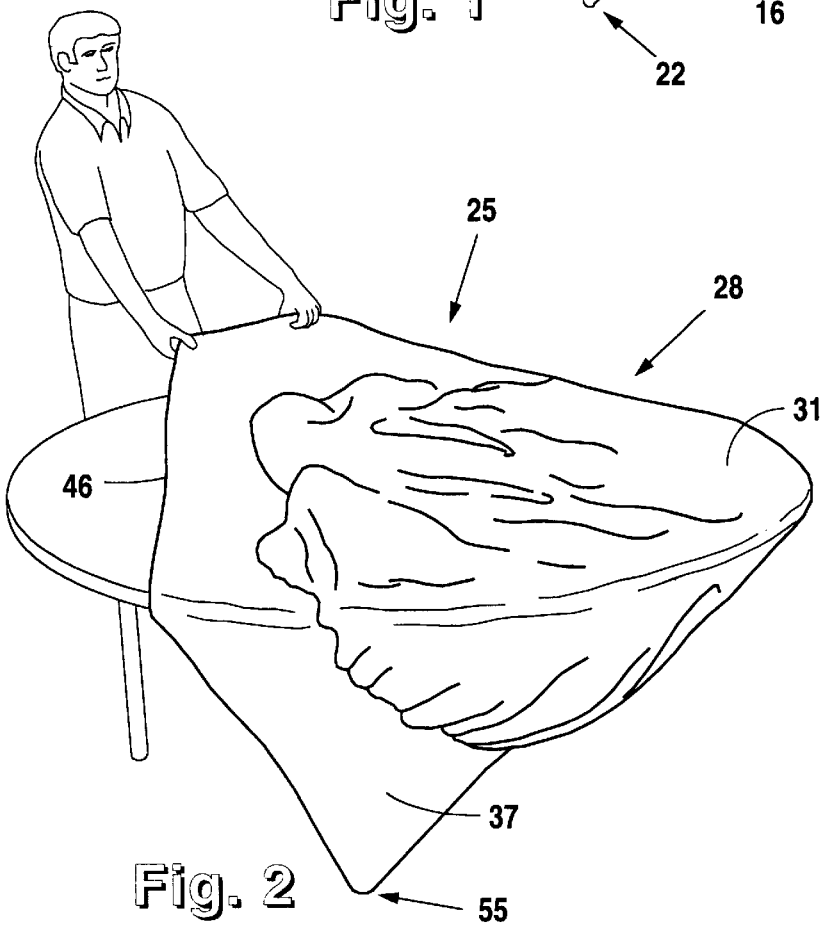
FIG. 2 and FIG. 3 illustrate subsequent steps of installation of the table cover body.

As illustrated in FIG. 2, installation continues as the installer 11 moves from one leg 19 to the next anchoring the bottom portion 37 of the cover 28 under the foot portion 22 of each leg 19 at a securable location 52 until finally the configuration of FIG. 3 is achieved. There, it can be appreciated that extension portions 61 span between the securable locations 52 and when the cover 28 is installed upon a table 10 form upwardly extending arches 64 between each leg 19. As may be best appreciated in FIG. 4, each arch 64 provides a feet accommodating access area 67 for those persons who later sit at the covered table 10. This feature improves the comfort level for those persons attending the event and increases the usability of the tables 10.

In the illustrated embodiment, the top portion 31 of the table cover body 28 is round shaped and the bottom portion 37 is tubular. The tube of the bottom portion 37 is formed by sewing a sheet of material at end portions thereof utilizing a tube forming seam 43. The seam 43 may be advantageously utilized by an installer 11 to assure proper positioning of the table cover 28 upon the table 10. When beginning installation as shown in FIG. 1, the seam 43 is aligned with the initial leg 19 under which the bottom portion 37 is first anchored. If this system of installation is consistently utilized, a uniform appearance across the several tables 10 in an event setting will be achieved.

Figure 5:
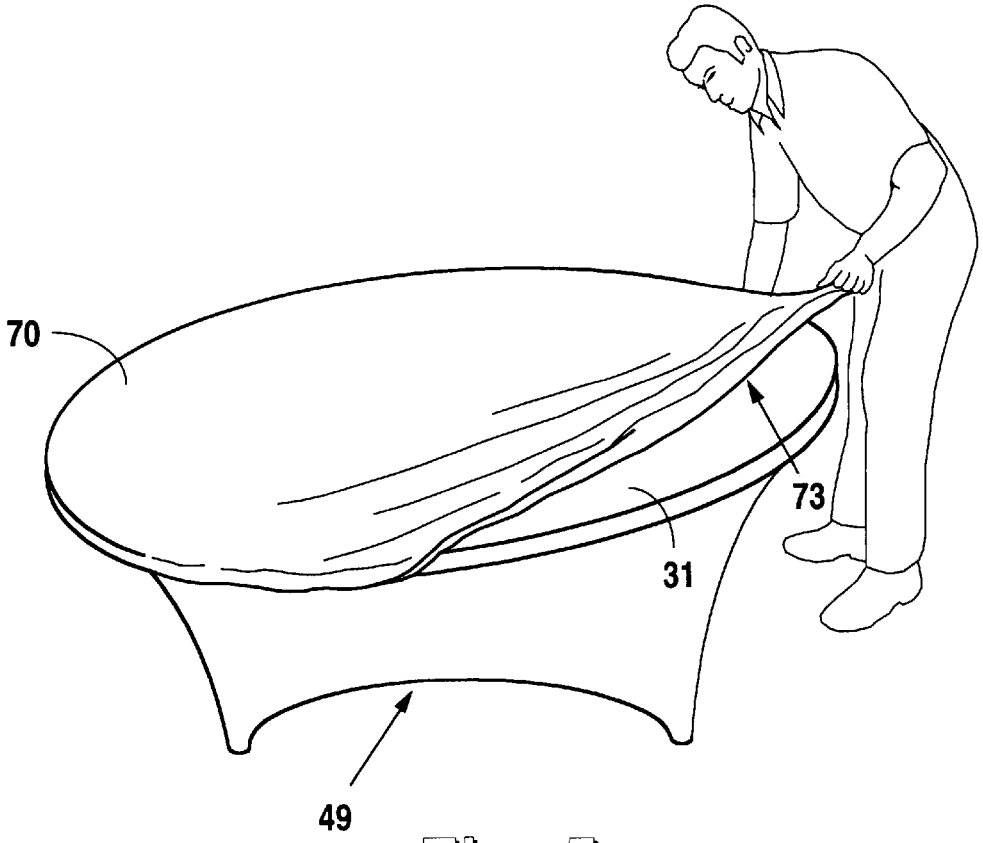
FIG. 5 is an intermediate step of installation of an overlay cover atop the table cover body.
Figure 6:
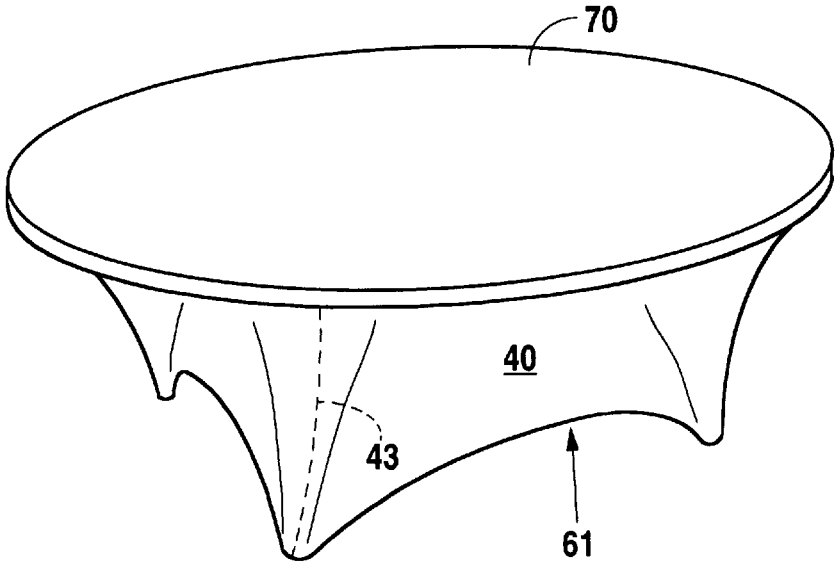
FIG. 6 is illustration of an appropriately installed table cover body and overlay cover.

An optional component of the table cover assembly 25 is an overlay tabletop cover 70. The utilization of such an overlay 70 is illustrated in FIGS. 4–6. Typically, the overlay 70 will have a specific design that has been selected to complement the theme of an event. Examples of such designs could include colored polka-dots, flag patterns or zebra stripes. In each case, the overlay 70 is preferably constructed of a stretch material that is secured about the top 13 of the table 10 over the top portion 31 of the table cover body 28 utilizing a peripheral elastic band 73. The more the overlay 70 is stretched, the more transparent the material becomes. This is especially true at the light-colored portions of the designs in the overlay 70. For this reason, the top portion 31 of the table cover body 28 is preferably constructed from a light-colored material, and most preferably from a white material. In this way, lighter colors of the overlay 70 are not washed out by a dark underlay, but are instead preserved and enhanced by the light color of the top portion 31 of the underlying cover 28.

The overlay 70 is an important component because it incorporates adaptability into the table cover assembly 25. By using the same basic table cover bodies 28 with different overlay covers 70, dramatically different appearances can be achieved utilizing the same cover 28 and table 10. This is a very attractive feature to party planners who must be able to provide a wide range of looks on a finite budget. In a typical embodiment, the bottom portion 37 of the cover 28 will usually be constructed from a dark colored material such as black spandex which forms an opaque skin 40 about the legged portion 16 of the table 10 when properly installed. In this configuration, the table cover assembly 25 presents a solid sculpted appearance over the previously unattractive skeletal table 10 available for most convention and party events.

A table cover and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

INDUSTRIAL APPLICABILITY

The present invention finds special applicability in the convention, party and event planning industries.

What is claimed and desired to be secured by Letters Patent is as follows:

1. A fabric table cover assembly comprising:

a table cover body having a top portion configured for covering a top of a table and a bottom portion configured for covering at least a portion of a supporting legged portion of the table;

said bottom portion of said cover body having a lower periphery configured to be anchored at securable locations, to a plurality of legs of the covered table; and said lower periphery having extension portions between adjacent securable locations, said extension portions being adapted to form upwardly extending arches between adjacent securable locations thereby establishing feet accommodating access areas between adjacent legs of the covered table.

2. The fabric table cover assembly as recited in claim 1, wherein said top portion of said table cover body is light colored so that light colored overlay fabrics positioned upon said top portion are colorwise unaffected in appearance by said lop portion.

3. The fabric table cover assembly as recited in claim 2, wherein said light colored top portion of said table cover body is white for optimized color preservation of the overlay fabrics positioned upon said top portion.

4. The fabric table cover assembly as recited in claim 1, wherein said bottom portion of said table cover body is dark colored for forming an opaque skin about the supporting legged portion of the covered table.

5. The fabric table cover assembly as recited in claim 1, wherein said top portion and said bottom portion of said table cover body are separate fabric pieces joined together at a seam to form said table cover body, said seam being configured to be located immediately below the top of the covered table when installed thereupon.

6. The fabric table cover assembly as recited in claim 1, further comprising:

an overlay table top cover configured to cover said top portion of said table cover body for presenting a contrasting appearance to said bottom portion of said cover body.

7. The fabric table cover assembly as recited in claim 6, wherein said overlay table top cover is adapted to stretch tautly over said top portion of said table cover body for uniform surface-to-surface engagement between said overlay table top cover and said top portion of said table cover body.

8. The fabric table cover assembly as recited in claim 6, wherein said overlay table top cover further comprises a peripheral elastic band for constriction below the top of the covered table when installed thereupon.

9. The fabric table cover assembly as recited in claim 6, wherein said overlay table top cover is constructed from stain and wrinkle resistant material.

10. The fabric table cover assembly as recited in claim 1, wherein each said securable location further comprises a hookable portion of said bottom portion of said table cover body configured for being securingly hooked under a respective leg of the covered table.

11. The fabric table cover assembly as recited in claim 1, wherein each said securable location further comprises a cupped receiver positioned at said lower periphery of said bottom portion of said table cover body, said cupped receiver configured to securably receive a foot portion of a respective leg of the covered table.

12. The fabric table cover assembly as recited in claim 11, wherein each said cupped receiver is adapted to be releasably engageable upon said lower periphery of said bottom portion of said table cover body.

13. The fabric table cover assembly as recited in claim 1, wherein said bottom portion of said table cover body is constructed from stretch fabric and is configured to fit tautly about the supporting legged portion of the covered table thereby presenting a curvaceous appearance about the supporting legged portion of the covered table when installed thereupon.

14. The fabric table cover assembly as recited in claim 13, wherein said stretch fabric from which said bottom portion of said table cover body is constructed is spandex material.

15. The fabric table cover assembly as recited in claim 13, wherein said top portion of said table cover body is constructed from stain and wrinkle resistant material.

16. The fabric table cover assembly as recited in claim 1, wherein said bottom portion of said table cover body further comprises a peripheral elastic band for constriction about a lower portion of the supporting legged portion of the covered table thereby forming said upwardly extending arches and presenting a fluted appearance at a base of the covered table from a plurality of said arches.

17. The fabric table cover assembly as recited in claim 1, wherein said bottom portion of said table cover body is tubularly constructed.

18. The fabric table cover assembly as recited in claim 17, wherein said tubularly constructed bottom portion of said table cover body is formed from a sheet of material using a seam, said seam being configured to be aligned with one of the legs of the covered table.

* * * * *

Disclaimer and Dedication 6,003,451—Mitchell T. Kelldorf, Scotsdale, Ariz. TABLE COVER. Patent dated December 21, 1999. Disclaimer filed May 29, 2002 by the assignee, Sculptchair International, Inc.

Hereby disclaims and dedicates to the Public claims 1-10 and 13-18 of said patent.

*(Official Gazette, August 13, 2002)*